United States Patent [19]

Gabor et al.

[11] Patent Number: 4,737,043

[45] Date of Patent: Apr. 12, 1988

[54] IMPACT MECHANISM FOR QUIET IMPACT PRINTER

[75] Inventors: Andrew Gabor, Alamo; John C. Dunfield, San Jose; George W. Bowers, Jr., Hayward; Richard G. Crystal, Los Altos, all of Calif.

[73] Assignee: Xerox Corporation, Stamford, Conn.

[21] Appl. No.: 928,741

[22] Filed: Nov. 10, 1986

Related U.S. Application Data

[63] Continuation of Ser. No. 751,335, Jul. 2, 1985, abandoned.

[51] Int. Cl.[4] ..... B41J 9/04

[52] U.S. Cl. ..... 400/157.2; 101/93.31; 101/93.48

[58] Field of Search ..... 400/144.2, 144.3, 157.1, 400/157.2, 157.3, 370, 375.3, 376, 385, 387, 389, 388, 388.1; 101/93.15, 93.16, 93.17, 93.19, 93.31, 93.32, 93.33, 93.48

[56] References Cited

U.S. PATENT DOCUMENTS

| | | | |
|---|---|---|---|
| 1,110,346 | 9/1914 | Reisser | 400/144.1 |
| 1,638,602 | 8/1927 | Stiebel | 400/376 X |
| 2,236,663 | 4/1941 | Adams | 400/144.2 |
| 2,769,029 | 10/1956 | Howard | 178/35 |
| 2,875,879 | 3/1959 | Auerbach | 400/389 |
| 3,704,667 | 12/1972 | Moss | 101/93.17 |
| 4,027,764 | 6/1977 | Kashio | 400/157.2 X |
| 4,180,766 | 12/1979 | Matula | 101/93.04 X |
| 4,347,786 | 9/1982 | Sweat, Jr. et al. | 400/144.2 X |
| 4,423,972 | 1/1984 | Inoue et al. | 400/157.1 X |
| 4,525,086 | 6/1985 | Field et al. | 400/144.2 |

FOREIGN PATENT DOCUMENTS

| | | | |
|---|---|---|---|
| 0028539 | 5/1981 | European Pat. Off. . | |
| 2242086 | 3/1973 | Fed. Rep. of Germany | 400/154.1 |
| 2806277 | 8/1979 | Fed. Rep. of Germany | 400/144.2 |
| 2061155 | 12/1979 | Fed. Rep. of Germany | 101/93.48 |
| 103773 | 6/1984 | Japan | 400/144.2 |
| 2057974 | 4/1981 | United Kingdom . | |

*Primary Examiner*—Charles A. Pearson
*Attorney, Agent, or Firm*—Serge Abend

[57] ABSTRACT

An impact mechanism for an improved serial impact printer for delivering a printing force to drive a character element against a platen by means of a print tip movable toward and away from the platen. The print tip is supported upon a carriage mounted upon the printer for reciprocating movement in a path substantially parallel to the axis of the platen. The impact mechanism includes a bail bar extending substantially across the printer and mounted for rocking movement toward and away from the platen, its axis of rocking being substantially parallel to the axis of the platen. A prime mover is connected to the bail bar for imparting controlled rocking movement thereto. The print tip and the bail bar are interconnected so as to move the print tip toward and away from the platen as the bail bar is rocked.

9 Claims, 5 Drawing Sheets

IMPACT MECHANISM FOR QUIET IMPACT PRINTER

This is a continuation of application Ser. No. 751,335, filed July 2, 1985, now abandoned.

FIELD OF THE INVENTION

This invention relates to the impact mechanism for an improved serial impact printer and, more particularly, to a novel printer designed to substantially reduce impact noise generation during the printing operation.

BACKGROUND OF THE INVENTION

The office environment has, for many years, been the home of objectionable noise generators, viz. typewriters and high speed impact printers. Where several such devices are placed together in a single room, the cumulative noise pollution may even be hazardous to the health and well being of its occupants. The situation is well recognized and has been addressed in the technical community as well as in governmental bodies. Attempts have been made to reduce the noise by several methods: enclosing impact printers in sound attenuating covers; designing impact printers in which the impact noise is reduced; and designing quieter printers based on non-impact technologies such as ink jet and thermal transfer. Also, legislative and regulatory bodies have set standards for maximum acceptable noise levels in office environments.

Typically, impact printers generate an average noise in the range of 70 to just over 80 dBA, which is deemed to be intrusive. When reduced to the 60–70 dBA range, the noise is construed to be objectionable. Further reduction of the impact noise level to the 50–60 dBA range would improve the designation to annoying. Clearly, it would be desirable to reduce the impact noise to a dBA value in the low to mid-40's. The "A" scale, by which the sound values have been identified, represents humanly perceived levels of loudness as opposed to absolute values of sound intensity and will be discussed in more detail below. When considering sound energy represented in dB (or dBA) units, it should be borne in mind that the scale is logarithmic and that a 10 dB difference means a factor of 10, a 20 dB difference means a factor of 100, 30 dB a factor of 1000 and so on. We are looking for a very aggressive dropoff in printer impact noise.

The printing noise referenced above is of an impulse character and is primarily produced as the hammer impacts and drives the type character pad against the ribbon, the print sheet and the platen with sufficient force to release the ink from the ribbon. The discussion herein will be directed solely to the impact noise that masks other noises in the system. Once such impact noise has been substantially reduced, the other noises will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

Since it is the impact noise which is modified in the present invention, it is necessary to understand the origin of the impact noise in conventional ballistic hammer impact printers. In such typical daisywheel printers, a hammer mass of about 2.5 grams is driven ballistically by a solenoid-actuated clapper; the hammer hits the rear surface of the character pad and impacts it against the ribbon/paper/platen combination, from which it rebounds to its home position where it must be stopped, usually by another impact. This series of impacts is the main source of the objectionable noise.

Looking solely at the platen deformation impact, i.e. the hammer against the ribbon/paper/platen combination, the total dwell time is typically in the vicinity of 100 microseconds. Yet, at a printing speed of 30 characters per second, the mean time available between character impacts is about 30 milliseconds. Clearly, there is ample opportunity to significantly stretch the impact dwell time to a substantially larger fraction of the printing cycle than is typical of conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, an attendant reduction in noise output can be achieved, as will become apparent in the following discussion.

The general concept—reduction in impulse noise by stretching the deformation pulse—has been recognized for many decades. As long ago as 1918, in U.S. Pat. No. 1,261,751 (Anderson) it was recognized that quiet operation of the printing function in a typewriter may be achieved by increasing the "time actually used in making the impression". Anderson uses a weight or "momentum accumulator" to thrust each type carrier against a platen. Initially, the force applying key lever is struct to set a linkage in motion for moving the type carriers. Then the key lever is arrested in its downward motion by a stop, so that it is decoupled from the type carrier and exercises no control thereafter. An improvement over the Anderson actuating linkage is taught in Going, U.S. Pat. No. 1,561,450. A typewriter operating upon the principles described in these patents was commercially available.

Pressing or squeezing mechanisms are also shown and described in U.S. Pat. No. 3,918,568 (Shimodaira) and U.S. Pat. No. 4,147,438 (Sandrone et al) wherein rotating eccentric drives urge pushing members against the character/ribbon/sheet/platen combination in a predetermined cyclical manner. It should be apparent that an invariable, "kinematic" relationship (i.e. fixed interobject spacings) between the moving parts renders critical importance to the platen location and tolerances thereon. That is, if the throat distance between the pushing member and the platen is too great, the ribbon and the sheet will not be pressed with sufficient force (if at all) for acceptable print quality and, conversely, if the throat distance is too close, the pushing member will cause the character pad to emboss the image receptor sheet. Sandrone et al teaches that the kinematic relationship may be duplicated by using a solenoid actuator, rather than a fixed eccentric (note alternative embodiment of FIGS. 14 through 17). Pressing action may also be accomplished by simultaneously moving the platen and the pushing member, as taught in U.S. Pat. No. 4,203,675 (Osmera et al). In addition, Sandrone et al states that quiet operation relies upon moving a small mass and that noisy operation is generated by large masses. This theory is certainly in contravention to that applied in Anderson and Going (supra) and in U.S. Pat. No. 1,110,346 (Reisser) in which a mass multipler, in the form of a flywheel and linkage arrangement, is set in motion by the key levers to increase the effective mass of the striking rod which impacts a selected character pad.

A commercially acceptable printer must have a number of attributes not found in the prior art. First, it must be reasonably priced; therefore tolerance control and the number of parts must be minimized. Second, it must have print quality comparable to, or better, than that conventionally available. Third, it must have the same or similar speed capability as conventional printers. The first and the last factors rule out a printer design based upon squeeze action since tolerances are critical therein and too much time is required to achieve satisfactory print quality.

It is the primary object of the present invention to provide a novel impact mechanism for a quiet impact printer that is orders of magnitude quieter than that typical in today's marketplace, and which nevertheless achieves the rapid action and modest cost required for office usage.

SUMMARY OF THE INVENTION

The quiet impact printer of the present invention comprises, in one form, a novel impact mechanism for delivering a printing force to drive a character element against a platen by means of a print tip movable toward and away from the platen. The character element and the print tip are supported upon a carriage mounted upon the printer for reciprocating movement in a path substantially parallel to the axis of the platen. The impact mechanism includes a bail bar mounted for rocking movement toward and away from the platen, its axis of rocking being substantially parallel to the axis of the platen. The print tip and the bail bar are interconnected so as to move the print tip toward and away from the platen as the bail bar is rocked. A prime mover is connected to the bail bar for imparting controlled rocking movement thereto so as to impart the desired velocity to the print tip as it moves from a home position to the surface of said platen and then moves to deform said platen.

THEORY OF OPERATION OF THE INVENTION

As is the case in conventional ballistic hammer printers, the improved printer of this invention also is based upon the principle of kinetic energy transfer from a hammer assembly to a deformable member. The mass is accelerated, gains momentum and transfers its kinetic energy to the deformable member which stores it as potential energy. In such dynamic systems the masses involved and speeds related to them are substantial, so that one cannot slow down the operation without seeing a significant change in behavior. Taken to its extreme, if such a system is slowed enough its behavior disappears altogether and no printing will occur. In other words, a kinetic system will only work if the movable mass and its speed are in the proper relationship to one another.

Another attribute of the kinetic system is that it is self leveling. By this we mean that the moving mass is not completely limited by the drive behind it. Motion is available to it and the moving mass will continue to move until an encounter with the platen is made, at which time the exchange between their energies is accomplished. Therefore, since the point of contact with the platen is unpredictable, spatial tolerances are less critical, and the printing action of the system will not be appreciably altered by minor variations in the location of the point of contact.

Kinetic energy transfer systems are to be distinguished from kinematic systems in which the masses involved and the speeds related to them are much less important. The latter are typically represented by cam-operated structures in which the moving elements are physically constrained in an invariable cyclical path. They will operate as effectively at any speed. It doesn't matter how slowly the parts are moved. All that is important is the spatial relationship between the relatively movable parts. The cycle of operation will continue unchanged even in the absence of the deformable member. Consider the effect of a platen spacing which is out of tolerance. If the platen is too close, the invariant motion will cause embossing of the paper; if the platen is too far, printing will not be of satisfactory quality, or printing may not take place at all.

In order to understand the theory by which noise reduction has been achieved in the novel impact printer of this invention, it would be helpful to consider the mechanism by which sound (impulse noise) is generated and how the sound energy can be advantageously manipulated. In a fundamental sense, sound results from a mechanical deformation which moves a transmitting medium, such as air. Since we will want to maintain the amplitude of platen deformation substantially the same as in conventional impact printers in order to insure high quality printing, we will only consider the velocity of the deformation. As the deforming surface moves, the air pressure changes in its vicinity, and the propagating pressure disturbance is perceived by the ear as sound. Immediately adjacent the surface there will be a slight rarefaction (or compression) of the transmitting medium, because the surrounding air can fill the void (or move out of the way) only at a finite rate, i.e., the faster the deformation occurs, the greater will be the disturbance in the medium,. Thus, the resulting pressure difference and the resulting sound intensity depend upon deformation velocity, not merely upon amplitude of deformation. Intuitively we know that a sharp, rapid impact will be noisy and that a slow impact will be less noisy. As the duration of the deforming force pulse is increased, the velocity of the deforming surface is reduced correspondingly and the sound pressure is reduced. Therefore, since the intensity of the sound waves, i.e. the energy created per unit time, is proportional to the product of the velocity and pressure, stretching the deforming pulse reduces the intensity of the sound wave.

Taking this concept as our starting point, we consider the impact noise source, i.e. the platen deformation when hit by the hammer. The intervening character, ribbon, and paper will be neglected since they travel as one with the hammer. It has just been explained that sound intensity can be reduced by stretching the contact period, or dwell, of the impact. We also know that we have a substantial time budget (about 15 milliseconds) for expanding the conventional (100 microsecond) contact period by a factor of about 100. Furthermore, it is well known that manipulation of the time domain of the deformation will change the frequency domain of the sound waves emanating therefrom. In fact, as the impulse deformation time is stretched, the sound frequency (actually, a spectrum of sound frequencies) emanating from the deformation is proportionately reduced. In other words, in the above example, stretching the contact period by 100 times would reduce the corresponding average frequency of the spectrum by 100 times.

As the deformation pulse width is increased and the average frequency and frequency spectrum is reduced, the impact printing noise is lessened as the result of two phenomena. The first phenomenon has been described above, namely, reduction of the sound wave intensity, arising from the proportionality of sound pressure to the velocity of the deformation. A reduction factor of about 3 dB per octave of average frequency reduction, has been calculated. The second phenomenon, arises from the psychoacoustic perception of a given sound intensity. It is well known that the human ear has an uneven response to sound, as a function of frequency. For very loud sounds the response of the human ear is almost flat with frequency. But, at lower loudness levels the human ear responds more sensitively to sound frequencies in the 1000 to 5000 Hz range, than to either higher or lower frequencies. This "roll-off" in the response of the human ear is extremely pronounced at both the high and low frequency extremes.

A representation of the combined effect of the sound intensity and the psychoacoustic perception phenomena is illustrated in FIG. 1 wherein there is reproduced the well known Fletcher-Munson contours of equal loudness (dBA), plotted against intensity level (dB) and frequency (Hz) for the average human ear. The graph has been taken from page 569 of "Acoustical Engineering" by Harry F. Olson published in 1957 by D. Van Nostrand Company, Inc.. At 1000 Hz, the contours, which represent how the frequencies are weighted by the brain, are normalized by correspondence with intensity levels (i.e. 10 dB=10 dBA, 20 dB=20 dBA, etc.). As stated above, both dB and dBA are logarithmic scales so that a difference of 10 dB means a factor of 10; 20 dB means a factor of 100; 30 dB means a factor of 1000, and so on.

The following example illustrates the above described compound reduction in perceived impulse noise, achieved by expansion of the dwell time of the impact force. Consider as a starting point the vicinity of regions "a" in FIG. 1 which represents a conventional typewriter or printer impact noise level generated by an impact pulse of about 100 microseconds. It has a loudness level of about 75 dBA at a frequency of about 5000 Hz. An expansion of the impact dwell time to about 5 milliseconds represents a 50-fold dwell time increase, resulting in a comparable 50-fold (about 5.5 octaves) frequency reduction to about 100 Hz. This frequency shift is shown the line indicated by arrow A. A reduction factor of about 3 dB per octave, attributed to the slower deformation pulse, decreases the noise intensity by about 16.5 dB, along the line indicated by arrow B, to the vicinity of region "b" which falls on the 35 dBA contour. Thus, by stretching the impact time, the sound intensity per se has been decreased by about 16.5 dB, but the shift in the average frequency (to about 100 Hz) to a domain where the ear is less sensitive, results in the compound effect whereby impact noise is perceived to be about 40 dB quieter than conventional impact printers.

In order to implement the extended dwell time, with its attendant decrease in deformation velocity, it was found to be desirable to alter the impacting member. The following analysis, being a satisfactory first order approximation, will assist in understanding these alterations. For practical purposes, the platen, which generates noise during the deformation impact, may be considered to be a resilient deformable member having a spring constant "k". In reality it is understood that the platen is a viscoelastic material which is highly temperature dependent. The platen (spring) and impacting hammer mass "m" will move together as a single body during the deformation period, and may be viewed as a resonant system having a resonant frequency "f" whose pulse width intrinsically is decided by the resonant frequency of the platen springiness and the mass of the hammer. In a resonant system, the resonant frequency is proportional to the square root of k/m (or $f^2=k/m$). Therefore, since the mass is inversely proportional to the square of the frequency shift, the 50-fold frequency reduction of the above example would require a 2500-fold increase in the hammer mass. This means, that in order to achieve print quality (i.e. same deformation amplitude) comparable to the conventional ballistic-type impact printer it would be necessary to increase the mass of the typical hammer weighing 2.5 grams, to about 13.75 pounds. The need to control such a large hammer mass, while keeping the system inexpensive, would appear to be implausible.

Having seen that it is necessary to materially increase the mass, it is quickly understood that the quantitative difference we have effected is no longer one of degree, but is rather one of kind, signifying an entirely different, and novel, class of impact mechanism. The novel approach of the present invention makes the implausible quite practical. Rather than increasing the hammer mass per se, a mass transformer is utilized to achieve a mechanical advantage and to bring a large effective, or apparent, mass to a print tip through a unique drive arrangement. In addition to an increase in the magnitude of the effective mass, quality printing is achieved by the metering of sufficient kinetic energy to the platen to cause the appropriate deformation therein.

In the impact printer of the present invention, a heavy mass is set in motion to accumulate momentum, for delivery to the platen by the movable print tip, through a suitable linkage. The entire excursion of the print tip includes a throat distance of about 50 mils from its home position to the surface of the platen and then a deformation, or penetration, distance of about 5 mils. The stored energy, or momentum, in the heavy mass is transferred to the platen during deformation and is completely converted to potential energy therein, as the print tip is slowed and then arrested. As the print tip is the only part of the kinetic energy delivery system "seen" by the platen, it views the print tip as having the large system mass (its effective mass). It should be apparent, of course, that relative motion between the print tip and the platen may be accomplished, alternatively, by moving either the platen relative to a fixed print tip, or by moving both the print tip and the platen toward and away from one another.

In the preferred form of the present invention, the total kinetic energy may be metered out incrementally to the mass transformer. A first portion of the energy will move the print tip rapidly across the throat distance and a second portion of the energy will be provided at the initiation of the deformation period. By controlling the prime mover, the traverse of the throat distance may be accomplished by initially moving the print tip rapidly and then slowing it down immediately before it reaches the platen surface. This may be done by having regions of different velocity with transitions therebetween or it could be done by continuously controlling the velocity. It is desirable to slow the print tip to a low or substantially zero velocity immediately prior to the initiation of contact in order to decrease the impact noise. However, since its velocity at the initiation of contact would be too low for printing, an augmentation of kinetic energy must be imparted at that point in order to accelerate the print tip into the platen for accomplishing the printing.

Alternatively, it is possible to provide the mass transformer with the total kinetic energy it will need to cross the throat distance and to effect penetration of the platen. This energy would be metered out to the mass transformer by the system prime mover at the home position (i.e. prior to the initiation of the deformation period) and will set the mass transformer in motion. In order to carry out this procedure, a large force would have to be applied and it is apparent that more noise will be generated.

A major benefit may be obtained when we bifurcate the total kinetic energy and meter it for (a) closing down the throat distance (before contact), and (b) effecting penetration into the platen (after contact). Namely, the contact velocity will be low, resulting in inherently quieter operation. The metering may be accomplished so that the velocity of the print tip may be substantially arrested immediately prior to contact with the platen, or it may have some small velocity. What is important is that upon determination that contact has been made, an augmentation force is applied for adequate penetration.

We find that under certain conditions the application of the augmentation kinetic energy allows us to obtain the same penetration force and yet substantially decrease the effective mass, and thus the system mass. In order to understand why this is possible, the effect of momentum on deformation should be explored. In the following two examples, it is assumed that the same maximum platen deformation is effected, in order that comparable print quality is achieved. First consider a squeeze-type printer wherein the deforming force is applied so slowly that its momentum is negligible. As the print tip begins to deform the platen, its force is greater than, and overcomes, the platen restoring counterforce. When the print tip deforming force equals the platen restoring counterforce, the print tip mass will stop moving and the counterforce will prevail, driving the movable members apart. This will occur at the point of maximum platen deformation.

Now consider the kinetic system of the present invention, wherein the print tip is accelerated into the platen. It may either have a finite velocity or zero velocity at its moment of arrival. Then, as the accelerating print tip begins to exert a force on the deforming platen, it experiences the platen restoring counterfore. Initially the print tip deforming force will be greater than the platen restoring counterforce. However, unlike the precious example, the print tip force equals the platen restoring counterforce at the mid-point (not at the end) of its excursion. From that point, to the point of maximum deformation, the print tip's momentum will continue to carry it forward, while the greater counterforce is decelerating it. At the point of maximum deformation, all the print tip kinetic energy will have been converted to potential energy in the platen and the restoring force will begin to drive the print tip out.

We find that it is only necessary to apply half of the platen deforming force while the system momentum, in effect, applies the remaining half. We also find that since the hammer mass would have a longer excursion, if we want to limit penetration to the same amplitude, we must shorten the dwell time for the same penetration. Since, as stated above, the mass relates inversely to the square of the frequency, doubling the frequency allows us to reduce the mass by one-quarter.

Typical values in our unique impact printer are: an effective hammer mass at the point of contact of 3 pounds (1350 grams), a contact period of 4 to 6 milliseconds, and a contact velocity of 2 to 3 inches per second (ips). By comparison, typical values of these parameters in a conventional impact printer are: a hammer mass of 3 to 4 grams, a contact period of 50 to 100 microseconds, and a contact velocity of 80 to 100 ips. Even the IBM ball-type print element, the heaviest conventional impact print hammer, and its associated driving mechanism has an effective mass of only 50 grams.

We believe that a printer utilizing our principal of operation would begin to observe noise reduction benefits at the following parametric limits: an effective mass at the point of contact of 0.5 pounds, a contact period of 1 millisecond, and a contact velocity of 16 ips. Of course, these values would not yield optimum results, but there is a reasonable expectation that a printer constructed to these values would have some attributes of the present invention and will be quieter than conventional printers. For example, one would not obtain a 30 dB (1000×) advantage, but may obtain a 3 dB (2×) noise reduction. The further these values move toward the typical values of our printer, the quieter the printer will become.

BRIEF DESCRIPTION OF THE DRAWINGS

The advantages of the present invention will be understood by those skilled in the art through the following detailed description when taken in conjunction with the accompanying drawings, in which.

DETAILED DESCRIPTION OF THE ILLUSTRATED EMBODIMENT

Figure 1:
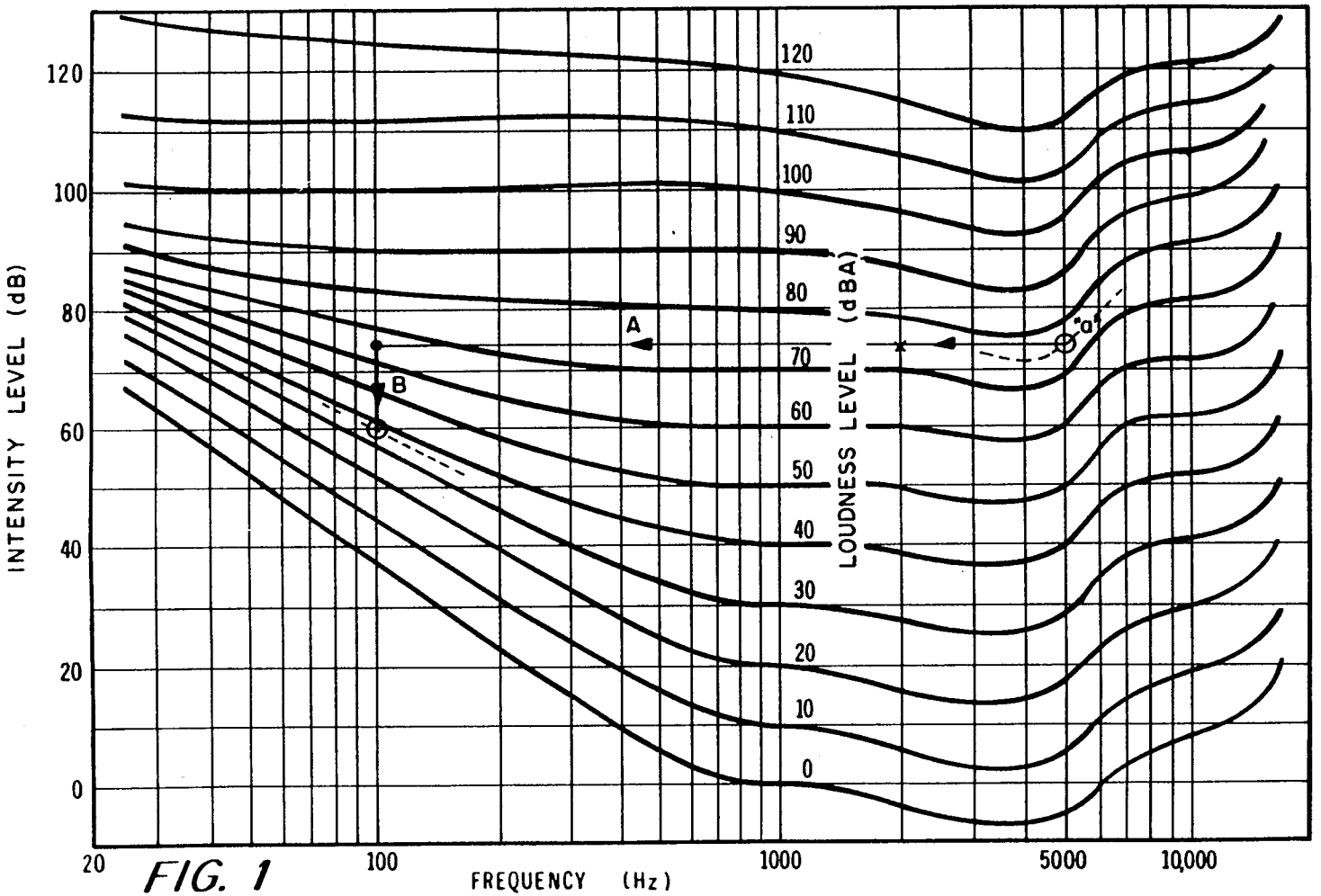
FIG. 1 is a graph showing contour lines of equal loudness for the normal human ear.
Figure 2:
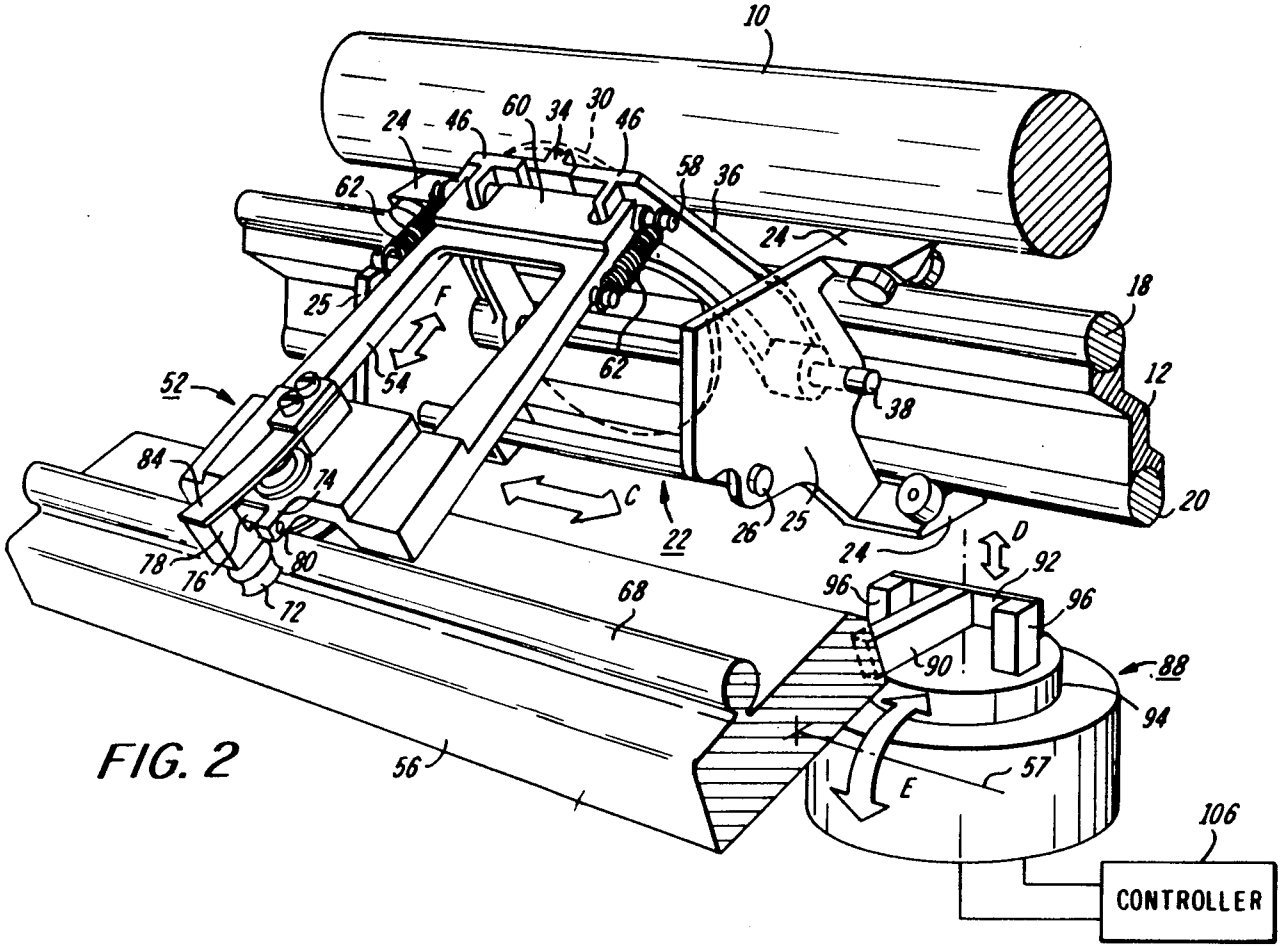
FIG. 2 is a perspective view of the novel impact printer of the present invention.
Figure 3:
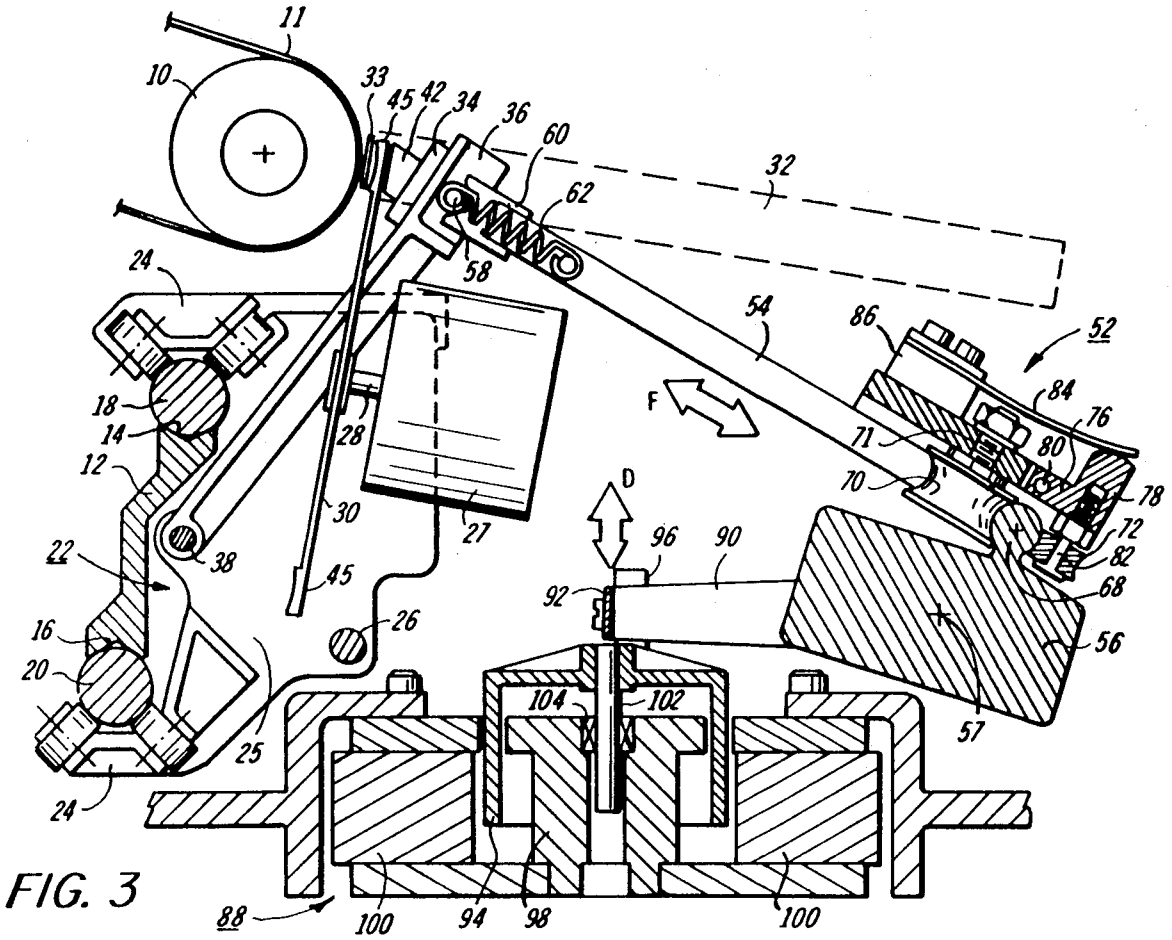
FIG. 3 is a side elevation view of the novel impact printer of the present invention showing the print tip spaced from the platen.
Figure 4:
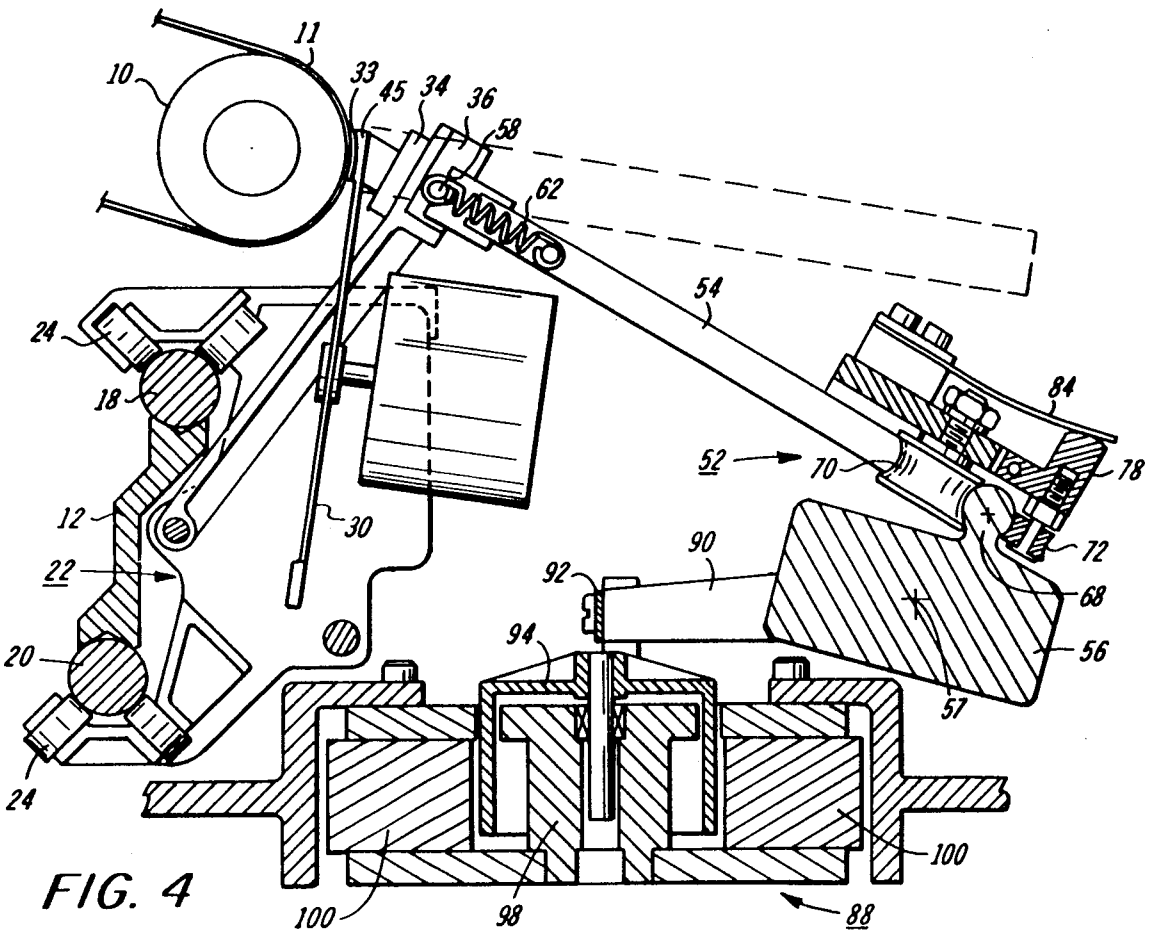
FIG. 4 is a side elevation view similar to FIG. 3 showing the print tip impacting the platen.
Figure 5:
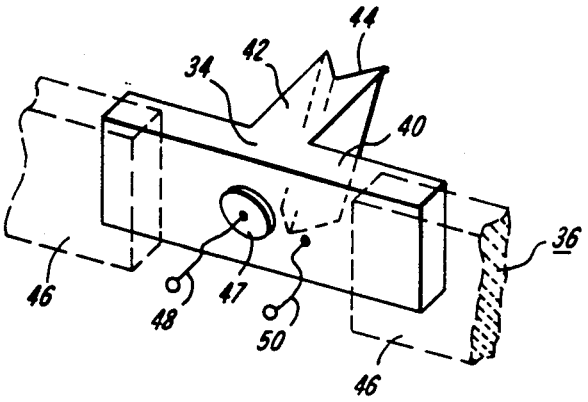
FIG. 5 is an enlarged perspective view of the back of the print tip.

The graph of FIG. 1 has been discussed above with reference to the theory of noise reduction incorporated in the present invention. Our novel impact printer will be described with particular reference to FIGS. 2 through 5. The illustrated printer includes a platen 10 comparable to those used in conventional impact printers. It is suitably mounted for rotation in bearings in a frame (not shown) and is connected to a drive mechanism (also not shown) for advancing and retracting a sheet 11 upon which characters may be imprinted. A carriage support bar 12 spans the printer from side to side beneath the platen. It may be fabricated integrally with the base and frame or may be rigidly secured in place. The carriage support bar is formed with upper and lower V-shaped seats 14 and 16 in which rod stock rails 18 and 20 are seated and secured. In this manner, it is possible to form a carriage rail structure having a very smooth low friction surface while maintaining relatively low cost.

It is important that the support bar 12 extends parallel to the axis of the platen so that the carriage 22 and the printing elements carried thereon will be accurately located in all lateral positions of the carriage, along the length of the platen. A cantilever support arrangement for the carriage is provided by four sets of toed-in rollers 24, two at the top and two at the bottom, which ride upon the rails 18 and 20. In this manner, the carriage is unobtrusively supported for moving several motors and other control mechanisms for lateral movement relative to the platen. A suitable carriage drive arrangement (not shown) such as a conventional cable, belt or screw drive may be connected to the carriage for moving it parallel to the platen 10 upon the support bar 12, in the direction of arrow C.

The carriage 22 is shown as comprising side plates 25 secured together by connecting rods 26 and supporting the toed-in rollers outboard thereof. Although the presently preferred form is somewhat differently configured, this representation has been made merely to more easily illustrate the relationship of parts. There is shown mounted on the carriage a printwheel motor 27 having a rotatable shaft 28 to which printwheel 30 is securable and a ribbon cartridge 32 (shown in phantom lines) which supports a marking ribbon 33 intermediate the printwheel and the image receptor sheet 11. A ribbon drive motor and a ribbon shifting mechanism, which are also carried on the carriage, are not shown.

In conventional printers the carriage also supports the hammer and its actuating mechanism. In our unique arrangement, the carriage only supports a portion of the hammer mechanism, namely, a T-shaped print tip 34 secured upon an interposer member 36. The interposer is in the form of a yoke whose ends are pivotably mounted in carriage 22 on bearing pin 38 so as to be constrained for arcuate movement toward and away from the platen 10. The print tip 34 includes a base 40 and a central, outwardly extending, impact portion 42 having a V-groove 44 in its striking surface for mating with V-shaped protrusions on the rear surface of printwheel character pads 45. Thus, upon impact, the mating V-shaped surfaces will provide fine alignment for the characters by moving the flexible spokes either left or right as needed for accurate placement of the character impression upon the print line of the receptor sheet 11. The outer ends of the base 40 are secured to mounting pads 46 of the interposer 36, for leaving the central portin of base unsupported. A strain sensor 47 is secured to the central portion of the base directly opposite the impact portion 42. Suitable electric output leads 48 and 50 are connected to the sensor and the print tip base, respectively, for relaying electrical signals, generated by the sensor, to the control circuitry of the printer. Preferably, the sensor comprises a piezoelectric wafer adhered to the base. It is well known that the piezoelectric crystal will generate an electric signal thereacross when subject to a strain caused by a stress. Thus, as soon as the impact portion 42 of the print tip pushes the character pad 45, the ribbon 33 and the image receptor sheet 11 against the deformable platen 10, the platen counterfore acting through the impact portion, will cause the beam of the print tip base 40 to bend, generating a voltage across the piezoelectric crystal strain sensor 47 and sending an electrical signal to the control circuitry, indicative of the moment of arrival of the print tip at the platen surface.

The remainder of the hammer force applying mechanism for moving the print tip comprises a mass transformer 52, remotely positioned from the carriage. It includes a push-rod 54 extending between the interposer 36 and a rockable bail bar 56 which rocks about an axis 57 extending parallel to the axis of the platen 10. As the bail bar is rocked toward and away from the platen, the push-rod moves the interposer in an arc about bearing pin 38, urging the print tip 34 toward and away from the platen. A bearing pin 58 mounted on the upper end of the interposer 36, provides a seat for the V-shaped driving end 60 of the push-rod 54. The two bearing surfaces 58 and 60 are urged into intimate contact by springs 62. At the opposite, driven end 64 of the push-rod, there is provided a resilient connection with an elongated driving surface of the bail bar, in the form of an integral bead 68. The bead is formed parallel to the rocking axis 57 of the bail. One side of the bead provides a transverse bearing surface for a first push-rod wheel 70, journalled for rotation on a pin 71 secured to the push rod. The opposite side of the bead provides a transverse bearing surface for a second push-rod wheel 72, spring biased thereagainst for insuring that the first wheel intimately contacts the bead. The aforementioned biasing is effected by providing the driven end of the push-rod with a clevis 74 to receive the tongue 76 of pivot block 78, held in place by clevis pin 80. The second wheel 72 is supported upon bearing pin 82 anchored in the pivot block. A leaf spring 84, cantilever mounted on a block 86 urges the pivot block 78 to bias the second wheel 72 against the bead 68 and effecting intimate contact of the fist push-rod wheel 70 against the bail bar bead 68.

Rocking of the bail bar about its axis 57 is accomplished by a prime mover, such as voice coil motor 88 through lever arm 90 secured to a flexure connector 92 mounted atop movable coil wound bobbin 94 on mounting formations 96. The voice coil motor includes a central magnetically permeable core 98 and a surrounding concentric magnet 100 for driving bobbin 94 axially upon support shaft 102 guided in bushing 104 in response to the current passed through the coil windings. The voice coil motor 88 is securely mounted on the base of the printer. Suitable electronic logic and circuitry, represented by the controller 106, is connected to the voice coil motor for energizing it in the proper sequence and at the proper magnitudes to move the print tip to the surface of the platen and then to deform the platen over the desired velocity trajectory.

The operation will now be described. Upon receiving a signal to initiate an impact, current is passed through the the coil wound bobbin 94 in one direction for drawing it downwardly in the direction of arrow D and for pulling lever arm 90 to rock bail bar 56 about its axis 57 in the direction of arrow E. Rocking movement of the bail bar causes bead 68 to drive push-rod 54 toward the platen 10, in the direction of arrow F. Since the push-rod is maintained in intimate contact with the interposer 36, the motion of the push-rod is transmitted to the print tip 34 which is driven to impact the deformable platen. As the carriage 22 is moved laterally across the printer, in the direction of arrow C, by its drive arrangement, the push-rod is likewise carried laterally across the printer between the interposer and the bail bar with driving contact being maintained by the spring biased wheels 70 and 72 straddling the bead rail. Conversely, when current is passed through the coil wound bobbin 94 in the opposite direction, it will be urged upwardly in the direction of arrows D for drawing the print tip away from the platen.

It can be seen that the magnitude of the effective mass of the print tip 34, when it contacts the platen 10, is based primarily upon the momentum of the heavy bail bar 56 which has been set in motion by the voice coil motor 88. The kinetic energy of the moving bail bar is transferred to the platen through the print tip, during the dwell or contact period, in which the platen is deformed and wherein it is stored as potential energy. By extending the length of the contact period and substantially increasing the effective mass of the print tip, we are able to achieve impact noise reduction of about 1000-fold, relative to conventional impact printers, in the manner described above.

Movement of the print tip is effected as described. By accurately controlling the timing of energization of the voice coil motor through suitable control circuitry, the voice coil motor may be driven at the desired speed for the desired time, so as to impart kinetic energy to the print tip. Thus, appropriate amounts of kinetic energy may be metered out prior to the contact or both prior to the contact and after contact. For example, a first large drive pulse may accelerate the bail bar and the print tip with sufficient kinetic energy to cause the print tip to cross the 50 mil throat distance and deform the platen by the desired amount (about 5 mil). Alternatively, an incremental drive pulse may merely meter out sufficient kinetic energy to accelerate the print tip across the throat distance through a preselected velocity profile which could cause the print tip to reach the platen with some predetermined velocity or may substantially arrest the print tip at the surface of the platen (compensating, of course, for the interposed character pad, ribbon and paper). As described above, the moment of arrival of the print tip at the platen is indicated by the signal emanating from the piezoelectric sensor 46. Subsequent to that signal, an additional application of kinetic energy may be provided by the voice coil motor to accelerate the print tip into the deformable platen surface to a desired distance and for a desired dwell time so as to cause the marking impression to be made. The application of force at the time of contact enables contact to be made at a lower velocity (generating less noise) than that which would have been needed if there were no opportunity for subsequent acceleration.

CONCLUSION

It should be understood that the present disclosure has been made only by way of example and that numerous changes in details of construction and the combination and arrangement of parts may be resorted to without departing from the true spirit and the scope of the invention as hereinafter claimed.

What is claimed is:

1. An impact mechanism in an impact printer, for delivering a printing force to drive a character element against a platen by means of a print tip normally spaced from the surface of said platen by a throat distance and movable toward and away from said platen, said character element and said print tip being supported upon a carriage mounted upon said printer for reciprocating movement in a path substantially coextensive with the axial length of said platen and substantially parallel to the axis of said platen, said impact mechanism being characterized by comprising;

a bail bar of substantially the same length as said platen, extending in a direction substantially parallel to the axis of said platen, said bail bar having an axis of rotation substantially parallel to the axis of said platen and being constrained to limited angular movement about its axis for movement toward and away from said platen, means for interconnecting said print tip and said bail bar so as to move said print tip toward and away from said platen as said bail bar is rocked, said means for interconnecting being supported upon and movable with said carriage and including means at a first end of said means for interconnecting for providing intimate moving contact with said bail bar in the direction of carriage movement and in both directions of movement of said bail bar, an interposer mounted upon and movable with said carriage and being further movable in an arcuate path toward and away from said platen, a second end of said means for connecting being attached to said interposer, wherein said print tip is supported upon said interposer for movement in said arcuate path, and drive means connected to said bail bar for imparting said limited angular movement thereto at a predetermined velocity so as to move said print tip therewith at a predetermined velocity as it is moved from a home position, across said throat distance and then to deform said platen.

2. The impact mechanism as defined in claim 1 characterized in that said bail bar includes guide means extending substantially parallel to said axis of angular movement, and said means for providing intimate moving contact moves upon said guide means for imparting linear movement to said means for interconnecting as said bail bar is moved angularly.

3. The impact mechanism as defined in claim 2 characterized in that said means for interconnecting has one end driven by said guide means and its opposite end in driving engagement with said interposer for moving said print tip against said character element.

4. The impact mechanism of claim 3 characterized in that said guide means comprises a bead-like formation having a pair of bearing surfaces and said one end of said means for interconnecting includes a pair of bearing means for straddling and moving upon said bearing surfaces.

5. The impact mechanism of claim 4 characterized in that said bearing means are biased against said bearing surfaces and said opposite end of said means for interconnecting is connected to and resiliently urged against said interposer.

6. The impact mechanism of claims 2 or 4 characterized in that said drive means comprises a voice coil electromagnet.

7. The impact mechanism of claim 6 characterized in that said drive means further comprises electronic control means for energizing said voice coil electromagnet.

8. The impact mechanism of claim 1 characterized in that said drive means and said means for interconnecting are each connected to said bar in a manner to effect a mechanical advantage to be achieved, so that the force delivered by said print tip, through said means for interconnecting, is greater, by a predetermined multiple, than the force applied by said drive means to said bail bar.

9. The impact mechanism of claim 8 characterized in that said bail bar serves to accumulate momentum which is delivered to said print tip as kinetic energy for deforming said platen.

* * * * *